US008097798B2

(12) United States Patent
McDonald

(10) Patent No.: US 8,097,798 B2
(45) Date of Patent: Jan. 17, 2012

(54) FINGER-MOUNTED STRIKING DEVICES FOR ACTIVATING MUSICAL INSTRUMENT STRINGS

(76) Inventor: Thomas E McDonald, Parkesburg, PA (US)

( * ) Notice: Subject to any disclaimer, the term of this patent is extended or adjusted under 35 U.S.C. 154(b) by 0 days.

(21) Appl. No.: 12/887,603

(22) Filed: Sep. 22, 2010

(65) Prior Publication Data

US 2011/0067551 A1 Mar. 24, 2011

Related U.S. Application Data

(60) Provisional application No. 61/245,299, filed on Sep. 24, 2009.

(51) Int. Cl.
*G10D 3/00* (2006.01)

(52) U.S. Cl. ..... 84/315

(58) Field of Classification Search ..... 84/315–322
See application file for complete search history.

(56) References Cited

U.S. PATENT DOCUMENTS 7,829,774 B2 * 11/2010 Moncrief ..... 84/315

* cited by examiner

*Primary Examiner* — Kimberly Lockett
(74) *Attorney, Agent, or Firm* — Joseph F. Aceto, Esq.

(57) ABSTRACT

The finger-mounted striking devices described herein are for use on stringed musical instruments, in particular for but not limited to electric or acoustic bass instruments. The paired devices consist of elongated cylindrical wooden shafts of differing length. The offset in length allows the striking tips to be effectively even when worn as intended on the index and middle fingers. The striking tip of each shaft contains a permanently embedded weight to accelerate the transfer of finger movement to the shaft tip. The mechanism for attaching the elongated shaft to each finger is an adjustable metal ring permanently attached to the shaft end opposite the striking tip. An upward-sloped fingertip rest is provided forward of the ring. The entire body of each elongated shaft and the integral metal ring are encased in an elastomeric coating that prevents scratching of the instrument surface during use by the devices and seals the metal ring against corrosion from moisture. Additional layers of elastomer coating are added to the striking tip to eliminate impact damage to the outer windings of instrument strings.

5 Claims, 3 Drawing Sheets

FINGER-MOUNTED STRIKING DEVICES FOR ACTIVATING MUSICAL INSTRUMENT STRINGS

CROSS-REFERENCE

The present application claims the benefit of priority of U.S. Provisional Application No. 61/245,299, filed Sep. 24, 2009, which is incorporated herein by reference.

FIELD OF THE INVENTION

This invention relates to the field of stringed musical instruments, and more specifically to finger-mounted devices used to rhythmically tap or strike bass instrument strings so as to produce musical notes with unique percussive undertones.

BACKGROUND OF THE INVENTION

Electric and acoustic bass instruments including the bass guitar, the upright double bass and cello provide the rhythmic foundation to musical compositions. Typical of the many types of popular musical genres that can be played on string instruments are rock, funk, soul, salsa, hip-hop, Cajun zydeco, classical and country.

Musicians performing musical compositions on acoustic or amplified bass instruments employ multiple methods of string activation. The traditional methods for activation of single or multiple bass strings to produce musical notes include: the combined use of fingers and thumb; use of a single finger-gripped plectrum commonly referred to as a pick; use of finger or thumb mounted picks; and use of a strung bow. More recent variations to traditional bass string activation methods include quickly plucking or snapping a string above the fretboard to produce notes with a popping undertone, and the use of a glancing thumb strike on a string to produce notes with a slapping undertone.

In a single performance a musician may employ any or all of the traditional and non-traditional methods of string activation. Common to all of the methods is constant, repetitive movement of the muscles, ligaments and joints comprising the human hand including the fingers, palm, wrist, forearm and elbow. A rehearsal session or live performance lasting several hours or more can lead to fatigue with loss of mobility in the fingers, palm and wrist of the string activating hand. Excessive overuse can eventually cause injury to the ligaments, joints and nerves of the hand, fingers, forearm and elbow.

OBJECTIVE OF THE INVENTION

One embodiment of the present invention provides for elastomer-coated, finger-mounted string activation devices for rhythmically tapping or striking bass instrument strings when positioned above the distal interphalangeal joint on the index and middle finger of a musician.

Another embodiment of this invention is to provide a method and means to instantly transmit a musician's finger movement to the striking tip of each shaft by use of a weight embedded in the tip that also provides a percussive undertone to each resultant note. Through controlled finger movement a musician can continuously alter the pressure and force of each delivered tap or strike to obtain unique and novel stylization of notes within a composition.

It is a further embodiment of the present invention to provide string activation devices that mount to the index and middle fingers by means of an adjustable metal ring that is coated with an elastomer that effectively prevents slippage of the device from the finger during use and further seals the metal surface of the ring against corrosion from moisture.

It is the further embodiment of the present invention to provide paired devices that can be worn by a musician on the right or left hand to provide a method for reducing the stress typically imparted to the ligaments, joints and nerves of the string activating hand.

SUMMARY OF THE INVENTION

The present invention provides a pair of string activation devices that are easily secured above the distal interphalangeal joint of the index and middle fingers on the right or left hand and are used to rhythmically tap or strike bass instrument strings to produce notes with a percussive undertone. The interior foundation of each device in a pair consists of an elongated cylindrical wooden shaft of differing length. The offset in length allows the striking tips to be effectively even when worn as intended on the index and middle fingers. The striking tip of each shaft contains a permanently embedded weight to accelerate the transfer of finger movement to the shaft tip. The mechanism for attaching the elongated shaft to each finger is an adjustable metal ring permanently attached to the shaft end opposite the striking tip. An upward-sloped fingertip rest is provided forward of the ring. The entire body of each elongated shaft and the integral metal ring are encased in an elastomeric coating that prevents scratching of the instrument surface by the devices and seals the metal ring against corrosion from moisture. Additional layers of elastomer coating are added at the striking tips to eliminate impact damage to the outer windings of instrument strings.

Additionally, the invention provides finger-mounted devices of novel design for use in pairs on stringed musical instruments that can be worn by a musician on the right or left hand while reducing the stress typically imparted to the ligaments, joints and nerves of the string activating hand. The controlled finger movements of a trained musician instantly transfer by kinetic force to the tip of each weighted shaft with a significant increase to the energy imparted at the striking tip.

Other objects and advantages of the invention will be seen when taken into consideration with the following drawings and specification.

DETAILED DESCRIPTION

Figure 1:
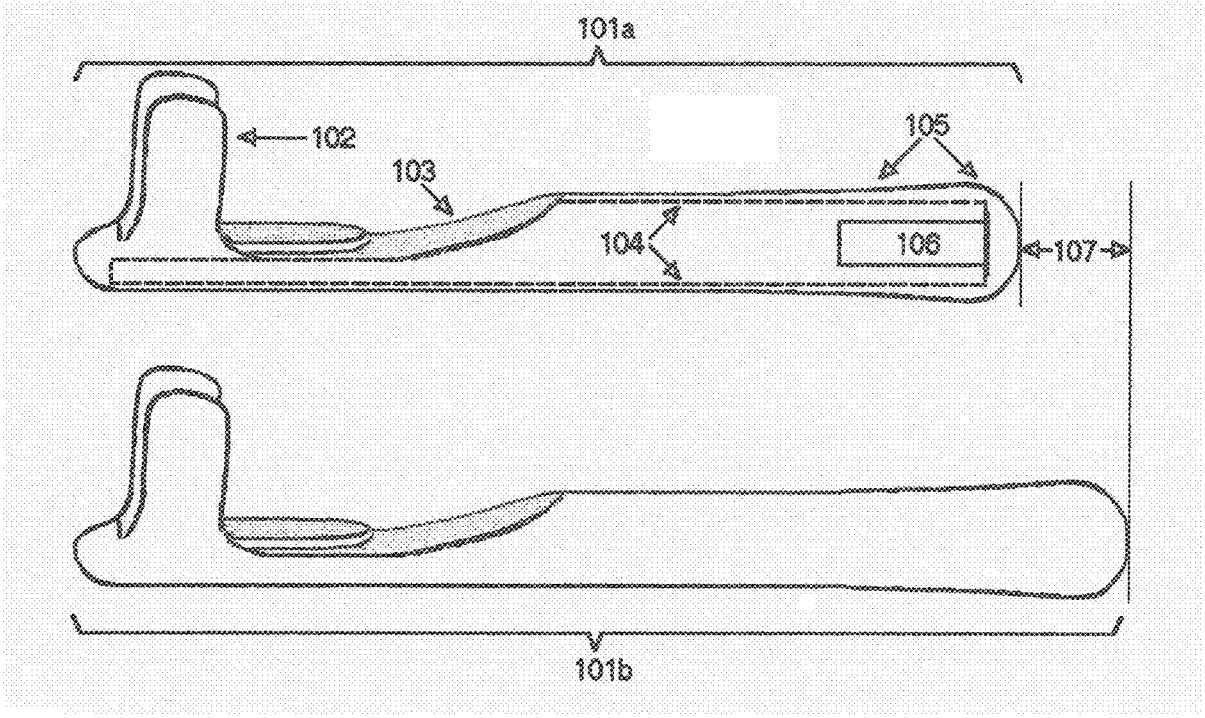
FIG. 1 is an elevational side view of the paired devices that provides details of interior and exterior construction.

FIG. 1 is an elevational side view of the paired devices 101*a* and 101*b* in accordance with the present invention. The details of construction illustrated by 101*a* indicate the adjustable metal ring 102, upward-sloped fingertip rest 103, elongated cylindrical wooden shaft 104, additional elastomer layers on the shaft at the string striking tip 105, shaft-embedded weight at the string striking tip 106, and the relative difference in length of the paired devices 107.

Figure 2:
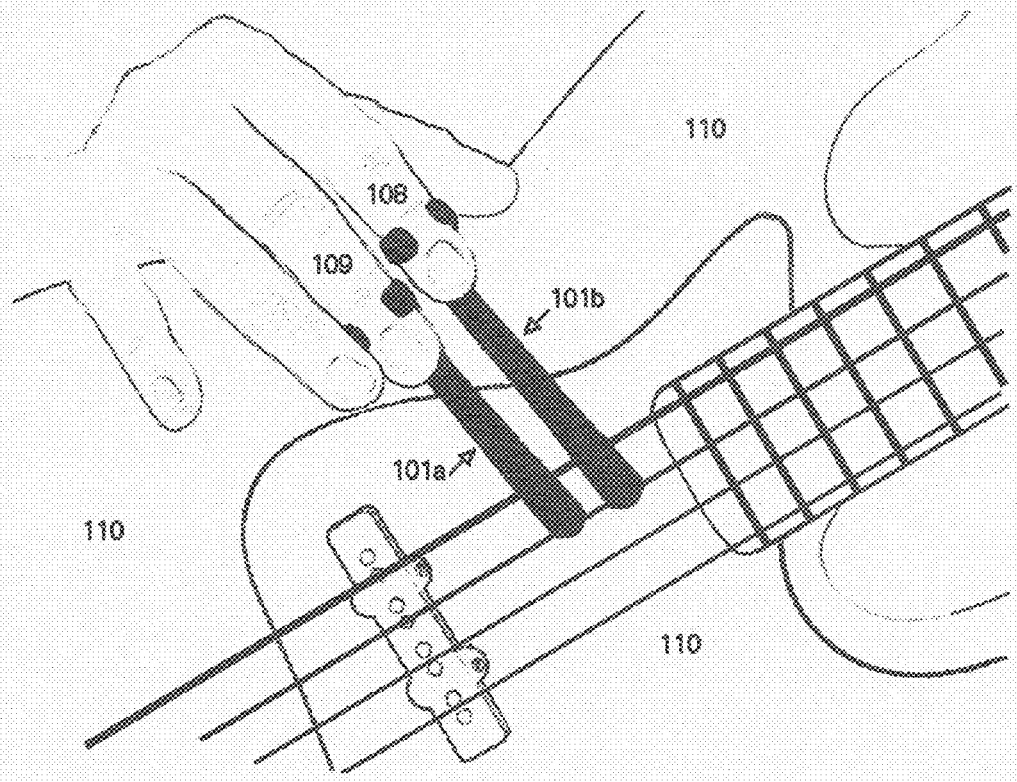
FIG. 2 is a perspective view of the paired finger-mounted striking devices of FIG. 1 with the striking tips in symmetrical contact with the strings of the instrument.

FIG. 2 is a perspective view of the paired devices 101*a* and 101*b* of FIG. 1 correctly positioned on the index 108 and middle 109 fingers of a musician when playing a right-handed electric bass instrument 110.

Figure 3:
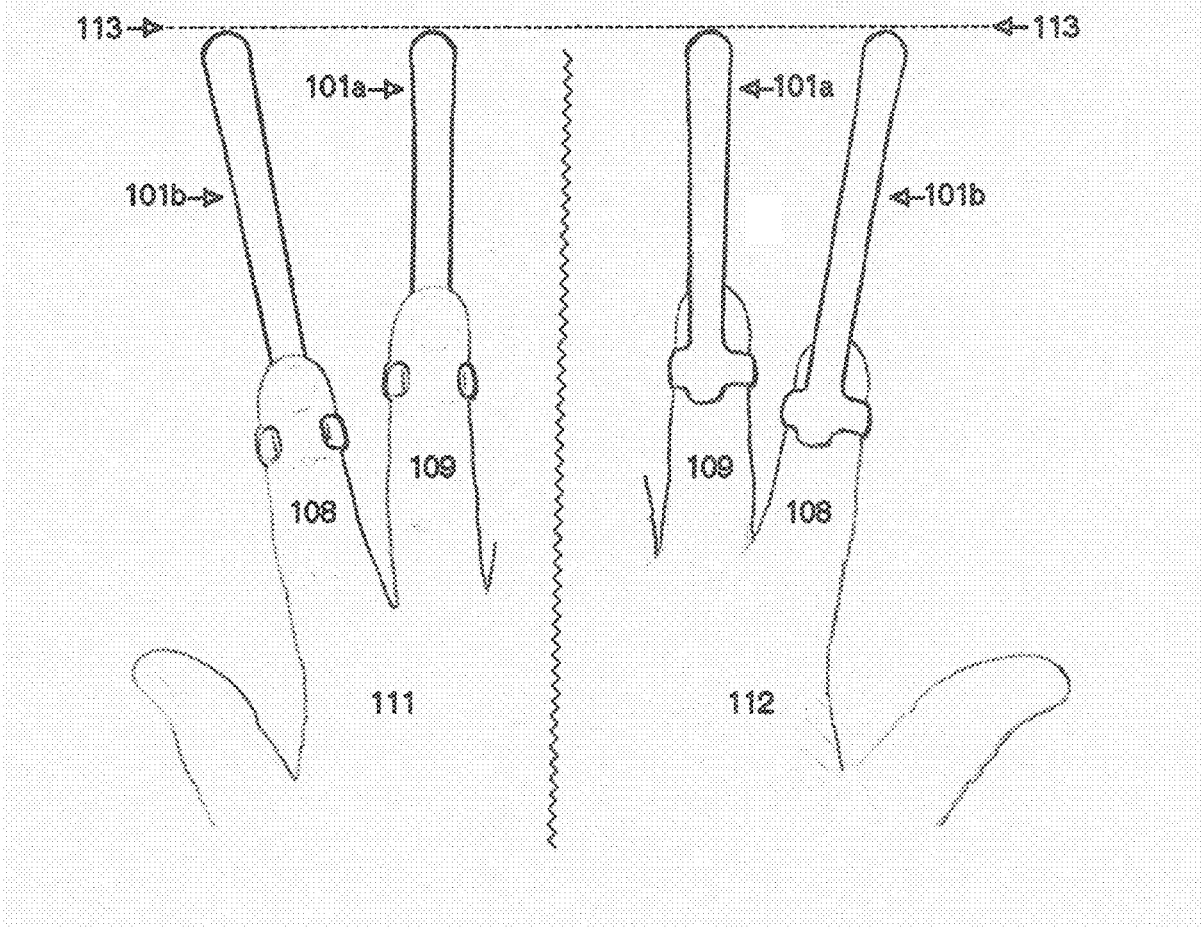
FIG. 3 are perspective views both palmar and dorsal of the paired finger-mounted striking devices illustrating the intended symmetrical length at the striking tip ends.

FIG. 3 are perspective dorsal 111 and palmar 112 views of the paired devices 101*a* and 101*b* of FIG. 1 correctly positioned above the distal interphalangeal joint on the index 108 and middle 109 fingers. As may be seen in FIG. 3, a symmetry in the length of both devices at the striking tip ends 113 is obtained when the paired devices are positioned correctly on the index 108 and middle 109 fingers.

The selection of the particular materials used to construct the shaft body, embedded weight and finger-mounting ring of the paired devices 101*a* and 101*b* of FIG. 1 include any composition known in the art such as, but not limited to, metal and wooden materials. In fact, any alternative materials such as durable plastics or ceramics that provide similar mechanical strength and longevity during repeated use of the finger-mounting ring and string striking tip are considered.

Another embodiment of the present invention considers a Metal Thumb Ring and combined Guitar Pick Holder for use with stringed musical instruments. The Metal Thumb Ring is adjustable for mounting the ring above the distal interphalangeal joint of any thumb. The mechanism inclusive to the Guitar Pick Holder provides guide channels to securely hold standard guitar picks. The available width of Guitar Pick Holder guide channels vary by intention so as to accommodate standard picks that are sized by thickness according to preference for flexibility.

A further embodiment is that the entire structure of the Metal Thumb-Mounting Ring and combined Guitar Pick Holder is encased in an elastomeric coating that prevents scratching of the instrument surface during use and seals the metal ring against corrosion from moisture. The elastomeric coating on the ring also provides additional friction to prevent slippage of the ring from the thumb.

The design of the Guitar Pick Holder mechanism is such that when properly mounted the pick is securely positioned on the palmar side of the thumb. Thus the pick is always accessible for full or intermittent use during performance of musical compositions and cannot be dropped or misplaced. The secured pick can be deployed for string activation by thumb movement alone or by use of the conventional thumb and index finger grip. The fingers of the musician are free at any time to strum or pick the instrument strings with no interference from the guitar pick holder. The Guitar Pick Holder has the further advantage of avoiding the cramps in the palm, thumb, or index finger sometimes experienced with the use of a standard pick. The conventional tight grip, used with a standard pick, is needed to control the rate of string attack and also to prevent dropping the pick during use. The Guitar Pick Holder allows precise control of the pick with very little thumb or index finger pressure, eliminating cramping and preventing muscle or ligament injuries.

Although the present invention has been described with reference to specific embodiments, workers skilled in the art will recognize that many variations may be made there from. It is to be understood and appreciated that the device in accordance with this invention is only one illustration of the many additional potential variations that may be envisioned by one of ordinary, skill in the art, and thus are not in any way intended to be limiting of the invention. Accordingly, other objects and advantages of the invention will be apparent to those skilled in the art from the detailed description together with the claims.

I claim:

1. A pair of finger-mounted devices to be used to rhythmically strike and tap the strings of bass instruments in order to produce notes containing percussive undertones, comprising:

a. a small-diameter cylindrical length of wood forming the shaft-like device body; an offset in the length of the shaft-like bodies so that the striking tips of the paired devices are effectively even in length;

b. an adjustable ring affixed to one end of the shaft-like body that allows mounting of the device securely to the index or middle finger; and c. a small-diameter metallic weight permanently embedded in the shaft tip opposite the affixed ring.

2. The pair of finger-mounted devices of claim 1 further comprising a finger ring affixed to the shaft-like body that is manually adjustable in size.

3. The pair of finger-mounted devices of claim 1 further comprising an upward-sloped finger rest forward of each adjustable ring.

4. The pair of finger-mounted devices of claim 1 further comprising an elastomeric coating applied to the shaft-like body and ring of each device.

5. The pair of finger-mounted devices of claim 1 further comprising additional layers of the elastomeric coating at the striking tip of each device.

* * * * *